United States Patent [19]

Meckler

[11] 4,300,623

[45] Nov. 17, 1981

[54] INTEGRATED MULTI-DUCT DUAL-STAGE DUAL-COOLING MEDIA AIR CONDITIONING SYSTEM

[76] Inventor: Milton Meckler, 16348 Tupper St., Sepulveda, Calif. 91343

[21] Appl. No.: 949,806

[22] Filed: Oct. 10, 1978

[51] Int. Cl.[3] ..... F25B 29/00; F24F 3/00

[52] U.S. Cl. ..... 165/16; 165/22; 165/50

[58] Field of Search ..... 165/16, 22, 50; 62/304, 62/332, 335

[56] References Cited

U.S. PATENT DOCUMENTS

| | | | |
|---|---|---|---|
| 3,024,008 | 3/1962 | Blum | 62/435 |
| 3,102,399 | 9/1963 | Meckler | 62/335 |
| 3,105,365 | 10/1963 | Harris et al. | 165/50 |
| 4,165,036 | 8/1979 | Meckler | 62/238 E |

*Primary Examiner*—Alfred E. Smith
*Assistant Examiner*—Janice A. Howell
*Attorney, Agent, or Firm*—William H. Maxwell

[57] ABSTRACT

A multi-duct air conditioning system integrating ventilation, humidity control, filtering, chilling and heating, and distribution of liquids, embodied in a combination of means operating at peak efficiency under varied conditions, characterized by a dual-stage refrigeration heat-pump apparatus with separate condensing of refrigerant subsequently comingled and expanded in a single evaporator supplying chilled water, and by a dual-media air conditioning apparatus with refrigeration chilled water and evaporatively cooled water for heat absorption from ventilation units, luminaires and space zones.

39 Claims, 4 Drawing Figures

SUB-COOLER
"51"
INTERSTAGE
"52"
COOLING
"57"
EVAPORATOR
"54"
RECOVERY
"49"
WASTE
"48"
HP
"47"
LP
"46"
HWR
CVWR
CWS
LPL
HPL
PSG
LPSG
HPDG
HPSG
LPDG
CHWS
EV-CHWR
G-L
SCL
V EXP
V REG
3 V
M ~

INTEGRATED MULTI-DUCT DUAL-STAGE DUAL-COOLING MEDIA AIR CONDITIONING SYSTEM

BACKGROUND

Air conditioning in generalities involves ventilating, humidity control, filtering, chilling and heating, and distribution as well. Efficiency is a dominant factor in each of the aforementioned phases of such a system, it being a general object of this invention to integrate these phases for efficient operation with the least amount of equipment and at relatively low installation cost.

Ventilation involves the movement of air throughout the livable space of a building structure and requires fans and ducts to distribute air between various inlets and outlets therefor, all of which varies with the particular installation. The livable building space varies in its heating and cooling requirements, there being perimeter space adjacent to outside walls as compared with interior space which is not. That is, perimeter space predominately requires greater application of space heating and/or cooling due to its proximity to the surrounding environment, while interior space is protected and requires a lesser degree of application. Accordingly, greater heat must be applied to the perimeter space than to the interior space in cold climates, while greater cooling must be applied to perimeter space than interior space in hot climates. The humidity factor is also to be considered, an independent factor that affects evaporative cooling and which is to be reduced in some climates in order to achieve comfort, with relatively low wet-bulb value being desirable. In view of these observations it is an object of this invention to provide ventilation integrated into the system hereinafter described and which correlates the aforesaid heating, cooling and humidity factors for efficient and comfortable operation of the system. With the present invention, several distinct spaces are to be serviced with heated and cooled air, and to this end it is an object of this invention to provide distinct heating and cooling means which responds to and meets with the individual requirements of said spaces.

Humidity control involves the relative wet-bulb values of outside air and useful space zone air, with means provided for exhaust air as well. As will be described in connection with cooling, humidity is an important factor since exhaust air is employed herein for its cooling effect in an evaporative cooler. Accordingly, it is an object of this invention to reduce humidity of incoming outside air, when so required, for the efficient cooling of the living space air within a building. With the present invention, the wet-bulb values of incoming air and space air is controlled for both living comfort and efficient system operation. Also and not specifically shown herein, filtering is to be included when required, for example a washer in addition to and/or incorporated in a humidifier.

Chilling and heating involves the expenditure of energy, the prior art installations therefor being characterized by separate humidifying, refrigerating, heating, and distributing equipment brought together as an aggregation to perform their separate functions. As a result, the efficiencies of these separate pieces of equipment have not been thoroughly correlated so that the operation of one always enhances the operation of the other. For example, a great portion of the energy expended in lighting is uselessly wasted in the luminaires, and consequently there are luminaires which are water cooled. For example, waste energy in large quantity from refrigeration has been discharged to atmosphere through cooling towers. And for example, single stage refrigeration has been widely adopted to operate at moderate heat transfer levels, which is a compromise between high and low level demands which invariably occur. Accordingly, it is an object of this invention to provide heat recovery from the lighting fixtures or luminaires, made efficient by utilizing cooled water efficiently supplied from an exhaust air evaporative cooler. It is also an object of this invention to minimize cooling tower waste by usefully employing a maximum amount of recoverable heat as energy to operate the system. And it is another object of this invention to provide multi-stage refrigeration that responds to the demands of both higher and lower temperatures. With the present invention, a first stage temperature range of heat transfer, i.e. 100°–130° F., is associated with a cooling tower efficient to discharge heat to ambient temperature air; and a second stage temperature range of heat transfer, i.e. 130°–160° F., is associated with energy distribution through the system for efficient space heating. Note that heat recovery from two compressor-condensor circuits is split through the use of separate condensors reserved for "recovered heat" and "waste heat" respectively.

Heat absorption into and out of the living space air is involved herein, it being an object of this invention to provide lighting fixtures in the form of luminaires that not only absorb radiant heat expended in lighting but also to absorb space zone heat surrounding said fixture-luminaire. In practice, the radiation of heat is directional so that the recessed lighting source is shielded for the greater part from the surrounding ceiling area by which heat is absorbed from the exposed underlying space. Accordingly, the fixture-luminaire provided herein is dual channel, having two separately operative cooling circuits serving two distinct functions; one to cool the lighting fixture by utilizing cooled water efficiently supplied from an exhaust air evaporative cooler, and the other to absorb heat from the living space by radiation and convection to said fixture surfaces by utilizing a mixture of refrigerant chilled and evaporatively cooled water. As will be described, the supplies of evaporatively cooled water and refrigerant chilled water are shared for their most efficient effect in each of the said two circuits.

Heat transfer fluid distribution is embodied herein, it being an object of this invention to minimize the piping involved in the aforesaid dual channel system involving evaporatively cooled water and refrigerant chilled water. It is to be understood that other suitable and most efficient liquids can be substituted for water as the heat transfer medium. In carrying out this invention, the fixtures or luminaires are characterized by the aforesaid dual channels which comingle at the exhaust of each fixture, so that a single return line suffices. Accordingly, each fixture has a comingling means, preferably a venturi fitting with orifices controlling the balance of flow and whereby the fluid having the higher rate of flow draws the other fluid into the return line therefor.

SUMMARY OF THE INVENTION

This invention involves the movement of air throughout the livable space of a building structure and employs the use of fans and ducting for distribution between outside air and luminaires or the like discharging separately into the perimeter and interior spaces of said building. Humidity is controlled for the efficient and utilitarian use of exhaust air in conjunction with evaporative cooling of heat transfer liquid efficiently employed in cooling the lighting fixtures, said fixtures in the form of luminaires having dual heat absorption channels for the separate functions of absorbing lighting heat and space zone heat. The chilling and heating involves, primarily, mechanical refrigeration or a heat pump characterized by two stages of compression and separate condensers for the efficient heat transfer at lower and higher ranges of temperature, one associated with minimized lower temperature waste heat discharged by a cooling tower and the other associated with maximum useful higher temperature heat discharged through a heat transfer media into the building structure space zones. Living space is advantageously isolated into perimeter space and interior space, and conditioned air is delivered thereto accordingly from separate air distribution networks into the perimeter space to be transferred into the interior spaces as required. There are separate supply lines for evaporatively cooled water and refrigerant chilled water, feeding the aforesaid dual channels of the luminaires, and there is a single return line from said luminaires to the evaporative cooler and to the refrigeration means. As shown in the drawings, these otherwise distinct means are incorporated into a single combination for efficient air conditioning.

DRAWINGS

The various objects and features of this invention will be fully understood from the following detailed description of the typical preferred forms and applications thereof, throughout which description reference is made to the accompanying drawings, in which.

PREFERRED EMBODIMENT

Figure 1:
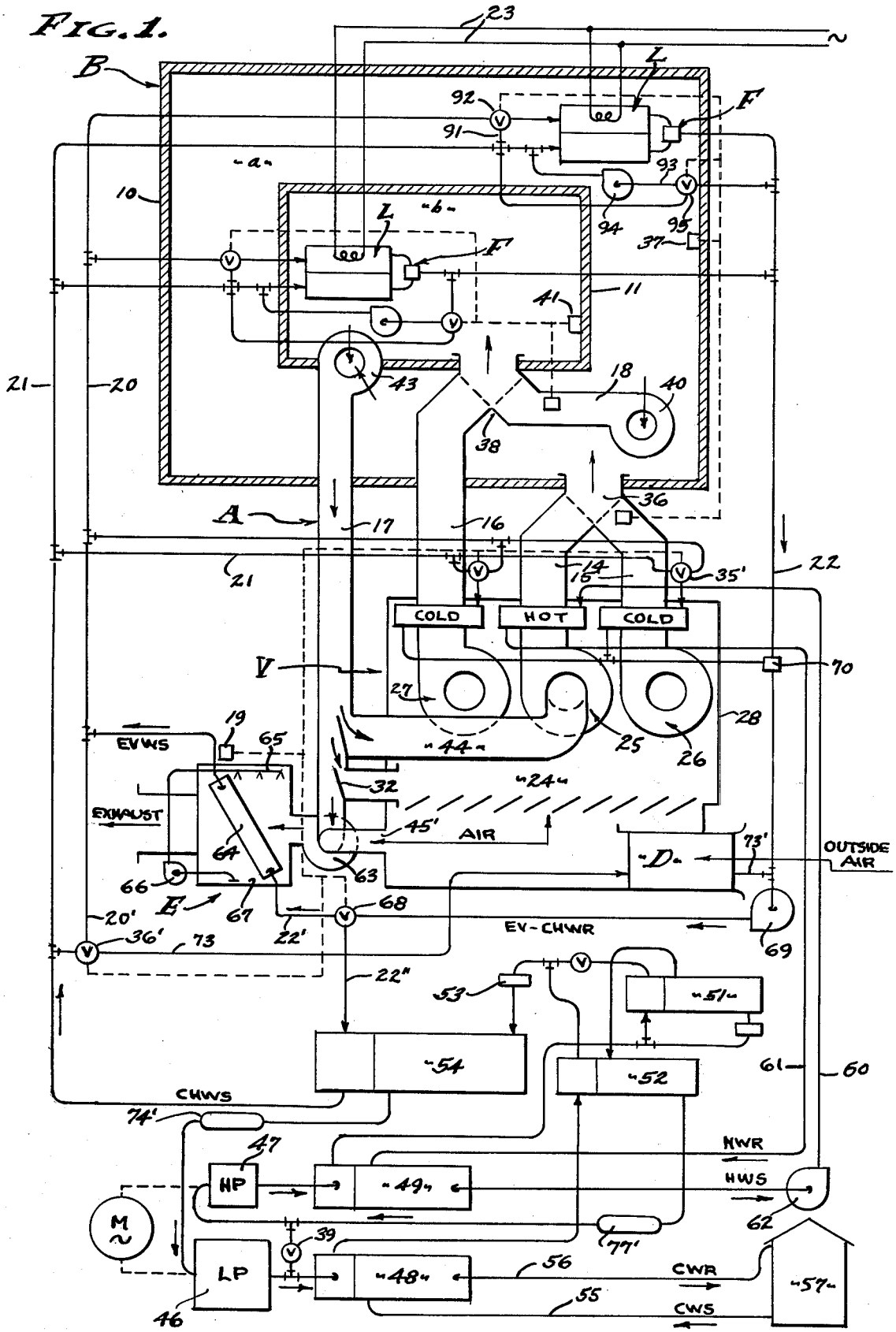
FIG. 1 is a total system diagram of the present invention.

Referring now to the integrated system as it is illustrated in FIG. 1 of the drawings, a building structure is indicated at B and comprised of a perimeter space zone a and an interior space zone b, and in each of which there are lighting fixtures L. The exterior walls 10 define the perimeter of the building and the interior walls 11 separate the interior space zone from the perimeter space zone, said walls extending between a floor 12 and a ceiling 13 (see FIG. 2). Doors and windows are not shown.

Fluid distribution means A to and from the space zones a and b involves conditioned air carried by hot and cold air ducts 14 and 15 to the perimeter space zone a, and by a cold air duct 16 to the interior space zone b, and also by a return air duct 17 from said zones, there being a zone transfer air duct 18 between zones a and b. Liquid distribution means F to and from the space zones a and b involves dual manifold supply lines for the heat transfer media, namely an evaporatively cooled water line 20 and a refrigeration chilled water line 21, and both of which extend to the lighting fixtures L. Further, the liquid distribution also involves a single return line 22 extending from the lighting fixtures L and an air circulation and ventilating means V. The aforesaid ducts and lines extend as indicated to the air circulation and ventilation means V, to a humidity control means D, and to a chilling-heating means C, and all of which are integrated and/or combined so as to be installed as an adjunct of or within or on or adjacent said building structure B. The electrical power for the lighting and other facilities is provided for the building separately as indicated by line 23, as is the power for operating the various fans, pumps and compressors of the system, as well as for any other equipment or machinery not shown.

Figure 2:
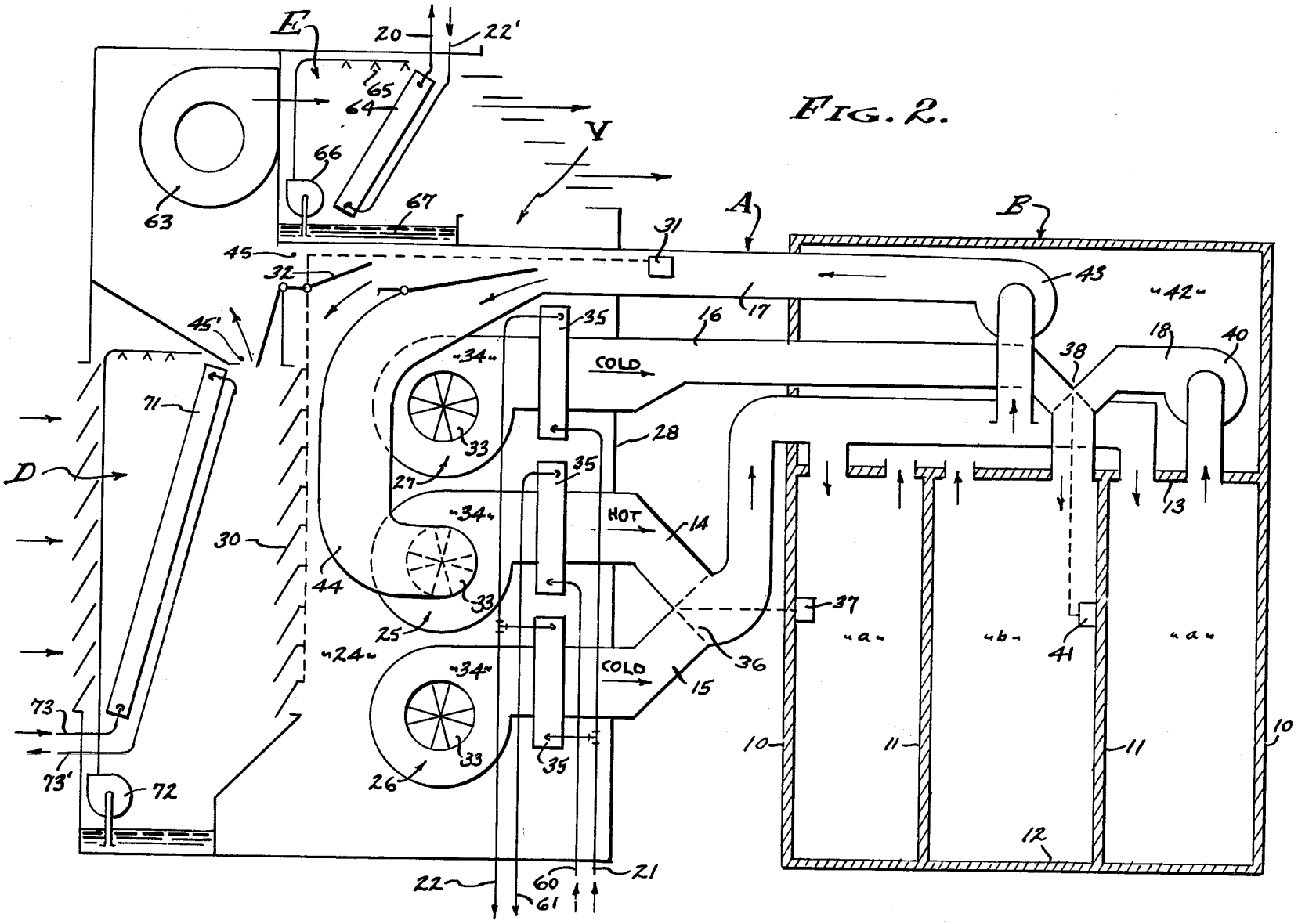
FIG. 2 is a schematic diagram of the ventilation means of the system.

Referring now to the air circulation and ventilation means V as it is illustrated in FIG. 2 of the drawings, there is an intake plenum 24 opening into a multiplicity of "cold" air conditioning blower units, and there is a singular intake 44 opening into at least one "hot" air conditioning blower unit. As shown, a hot and a cold blower unit 25 and 26 services the perimeter space zone a and a cold blower unit 27 services the interior space zone b. The number of blower units or hot and cold groups thereof will depend upon space zone requirements, and in practice they are combined into a single housing 28 to move separate air columns through the ducts 14–16 respectively. As shown, the housing 28 receives outside air through controlled damper means 30 responsive to a return air pressure sensor 31 which simultaneously controls damper means 32 restricting recirculation of exhaust from air duct 17. And, the intake 44 draws a portion of the return air from duct 17 to plenum 24 as required.

Each air conditioning blower unit comprises its individual vortex inlet damper 33 (or discharge damper, or variable speed drive, or the like), electrical powered blower 34 and heat exchanger 35, the air return duct 17 opening into the intake plenum of housing 28 to supply a portion of the return exhaust air to the multiplicity of cold air conditioning blower units. In carrying out this invention, the conditioned air supply of hot and cold blower units 25 and 26 are combined by a variable volume mixing valve 36 responsive to a space thermostat 37 in the perimeter space zone a serviced by said unit. And, the conditioned air supply of cold blower unit 27 through cold air duct 16 is combined with the air supplied through transfer duct 18 from sapce zone a by a variable volume mixing valve 38, there being an electric powered blower 40 to move a transfer column of air through said transfer duct 18, said blower 40 and variable volume mixing valve 38 being responsive to a space thermostat 41 in the interior zone b. It is to be understood that the transfer duct 18 and blower 40 is used to draw air from either zone a or b, and to transport air within either of said zones, as may be required.

Exhaust from the space zones a and b is into a ceiling plenum 42 from which the exhaust air duct 17 draws used conditioned air to be comingled and filtered when required with cold conditioned air, there being an electric powered blower 43 unit for driving exhaust air through the return air duct 17. Thus, the ventilation means is essentially a closed circuit through the intake plenum 24 of housing 28, and has a recirculation discharge through damper means 32 into plenum 24 and an exhaust discharge 45 into the evaporative cooler means E next described.

Referring now to the evaporative cooling means E as it is illustrated in FIGS. 1 and 2 of the drawings, the exhaust discharge 45 of return air duct 17 opens into an electric powered blower 63 that exhausts air to atmosphere through heat absorption tubes 64 over which a curtain of evaporative liquid is sprayed by nozzles 65 by means of a pump 66 from a sump 67. The tubes 64 are in circuit from return branch line 22' to the cold water line 20 through a three way diverter valve 68, there being a pump 69 forcefully moving a column of water through line 22 to be separated into cooling water and chilling water columns by said diverter valve. The source of return water is a mixing means 70 that comingles evaporatively cooled water return (EVWR) with chilled water return (CHWR), to be moved by said pump 69. The diverter valve 68 proportions the evaporative (EV) and chilled (CH) water return (WR) into two branch lines, line 22' to the evaporative cooling means E and line 22'' to the chilling means C, later described. In accordance with this invention, proportioning valves 68, 35' and 36' associated with dual media intake and supply are cooperatively controlled by an aquastat 19 responsive to media temperature in the evaporative cooling means E supply line 20 (EVWS). The proportioning by valve 68 is responsive to the aquastat and proportions the work load intake between the evaporative cooling means E to the mechanical refrigeration chilling-heating means C as circumstances require. As shown, the dual liquid media supply lines 20 and 21 extend to the cooled heat transfer units 35 through the three way modulating valves 35' responsive to the aquastat 19 and transfers the work load supply from the evaporative cooling means E to the mechanical refrigeration chilling-heating means C as circumstances require. The evaporative and chilled water supply through lines 20 and 21 are under pressure from pump 69, said lines and extensions thereof being in the nature of manifolds for distribution of cooled and chilled heat transfer media as circumstances require.

Associated with the evaporative cooling for the cooled water circuit delivered by line 20 is the dryness requirement of the exhaust air, which in practice can be mixed with new or outside air. In dry climates, outside air is used directly throughout the system, however in humid climates outside air is to be dehumidified as by means of the humidity control means D processing all outside air for space comfort and for system efficiency as well. As shown, a dehumidifier supplies both the plenum 24 of the air circulation and ventilation means V and the new air intake 45' of the evaporative cooling means E. The dehumidifer is indicated to be a liquid adsorption unit with extended surface contactor coils 71 employing a strong adsorbent or hygroscopic solution that is pumped from a sump 72 and sprayed over the coils in a contactor section thereof. A solution such as water and lithium or calcium chloride or ethylene glycol is used to process the incoming air to be dehumidified by intimate contact with the hygroscopic solution, the degree of dehumidification being dependent upon solution concentration, temperature, and other characteristics of the installation. As shown, evaporatively cooled and/or chilled water is supplied through valve 36' to line 73 and returned to pump 69 by line 73', controlling the temperature of coils 71. It is to be understood that the dehumidifier is used at the intake of outside air as circumstances require where the wet-bulb factor is to be lowered for efficiency of the system, and that the degree of dehumidification is controlled accordingly.

Figure 3:
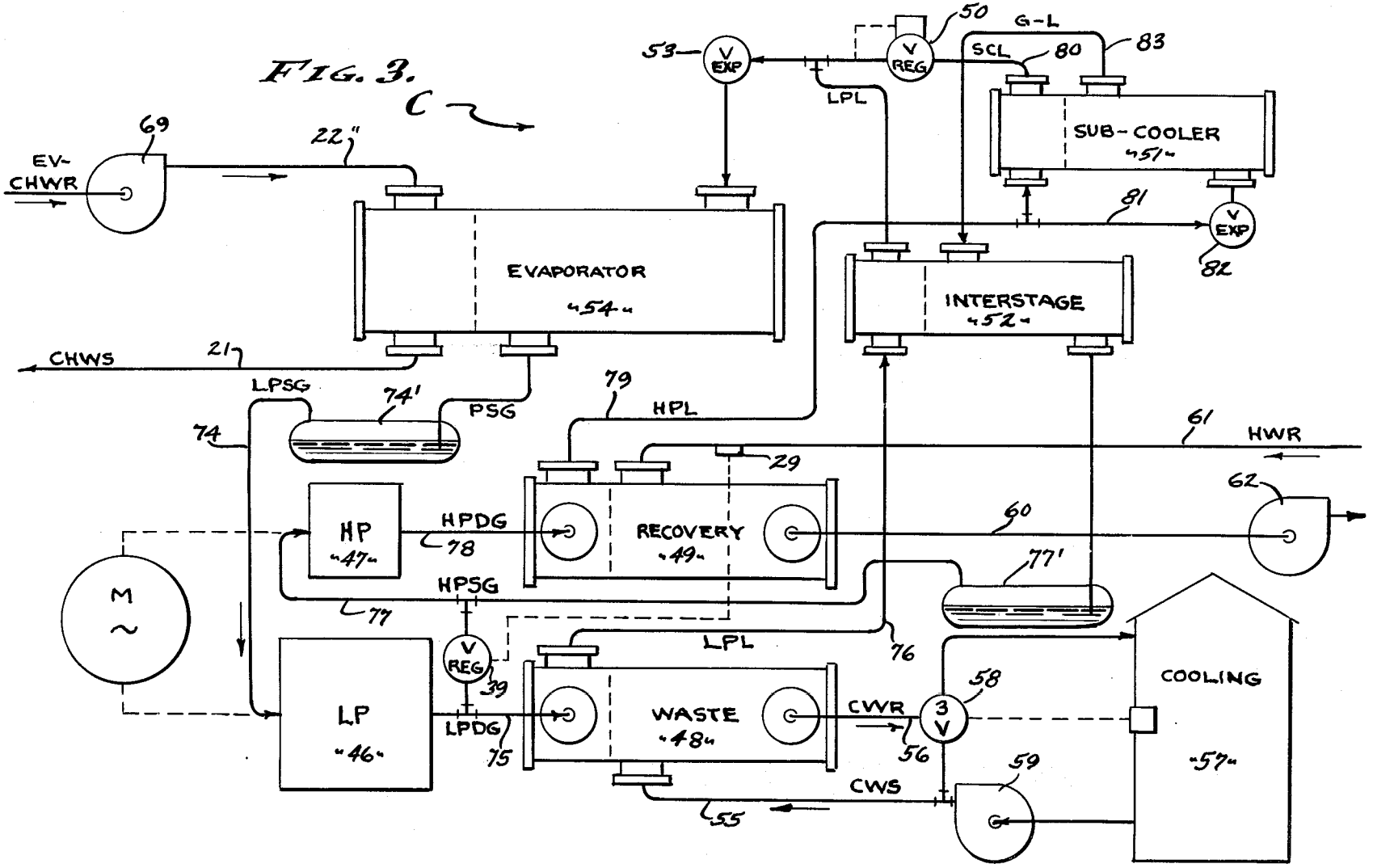
FIG. 3 is a schematic diagram of the chilling-heating means of the system.

Referring now to the chilling-heating means C as it is illustrated in FIG. 3 of the drawings, there is a heat pump in the form of a two stage refrigeration compressor 46-47 and two separate condensers 48-49 to absorb heat from the discharge gases compressed thereby respectively. In other words, there is a low pressure (LP) circuit 46-48 that operates for example in said 110°-130° F. range associated with waste heat control, and there is a high pressure (HP) circuit 47-49 that operates for example in said 130°-160° F. range associated with useful heat recovery. The low pressure and high pressure liquids (LPL and HPL) from said condensers are combined by reducing the pressure of the high pressure liquid at a pressure reducing valve 50 following a reduction in temperature in a refrigerant sub-cooler 51 from which the expended gas-liquid (G-L) is discharged and cooled by the low pressure gas in a refrigerant interstage cooler 52. The admixed gases that have been reduced in temperature are then passed through a refrigerant expansion valve 53 to absorb heat in an evaporator 54 which exchanges heat from a comingled chilled and evaporatively cooled water return line (EV-CHWR) branch 22'' to a chilled water supply line (CHWS) 21, hereinabove referred to as return line 22 and chilled water line 21 respectively.

The waste heat from condenser 48 is exchanged from a cooling water supply (CWS) line 55 to a cooling water return (CWR) line 56 through a cooling tower 57, as controlled by a three way thermostatically controlled valve 58 responsive to water temperature in the tower. A circulating pump 59 is provided to move the cooling water through this low stage condenser circuit for the discharge of waste heat.

The recovery heat from condensor 49 is usefully employed through heat exchanger 35 which transfers its heat to air from blower unit 25 through heating water supply (HWS) line 60 to a heating water return (HWR) line 61 through the heat exchanger 35 of said "hot" blower unit 25, there being a circulating pump 62 provided to move heating water through this higher temperature range condenser circuit.

The chilling-heating means C is a mechanical refrigeration system driven by a prime mover, shown as an electric motor M. The low pressure stage compressor 46 has a low pressure suction gas (LPSG) line 74 extending from the heat absorption section of the evaporator 54, taking therefrom the expended refrigerant to be recycled. A refrigerant receiver 74' is provided in said line to remove liquid as protection for the low pressure stage intake. A low pressure discharge gas (LPDG) line 75 extends to the refrigerant cooling-condensing section of the condenser 48 from which a low pressure liquid (LPL) line 76 extends through the interstage cooler 52 to the pressure reduced downstream side of valve 50 which is responsive to said low pressure so as to prevent backflow in line 76. The high pressure stage 47 of the compressor has a high pressure suction gas (HPSG) line 77 from the heat absorption section of the refrigerant interstage cooler 52, taking therefrom the expended refrigerant into which heat has been transferred to the low pressure liquid line 76. A refrigerant receiver 77' is provided in said line to remove liquid as protection for the high pressure stage intake. A high pressure discharge gas (HPDG) line 78 extends to the refrigerant cooling-condensing section of the condenser 49 from which a high pressure liquid (HPL) line 79 extends through the refrigerant sub-cooler 51 and via a supercooled liquid (SCL) line 80 to the pressure reducing valve 50 to comingle with the low pressure liquid of line 76 and subsequently expanded through valve 53 for heat absorption in the evaporator 54. Suction from the low pressure stage 46 to the high pressure stage 47 is equalized through a back pressure valve 39 in a transfer line from the low pressure discharge gas line 75 to the high pressure suction line 77 from the refrigerant receiver 77', valve 39 being controlled by a sensor 29 responsive to the temperature in hot water return line 61.

The refrigerant sub-cooler 51 is operated from the bypass of high pressure liquid through line 81, taken from line 79, and subsequently expended through an expansion valve 82 which operates to vaporize the liquid for heat absorption in the evaporator section of refrigerant sub-cooler 51. The completely or partially expanded refrigerant from said refrigerant sub-cooler is then directed via gas-liquid (G-L) mixture line 83 through the evaporator or heat absorption section of the refrigerant interstage cooler 52, and through a refrigerant receiver 77' for liquid separation prior to recycling through line 77 and compressor stage 47 as above described. Accordingly, it will be seen that the low pressure circuit of the refrigerant system is isolated from the high pressure circuit thereof, the said low pressure refrigeration being efficiently associated with normally ambient temperature heat transfer requirements (110°-130° F.), while the said high pressure refrigeration is efficiently associated with the useful heating level temperature requirements (130°-160° F.).

It is to be understood that various state of the art features such as unloading means, compressor speed control means, check valve means, protective means, and other control means are incorporated in the total system as circumstances require; although they are not shown here for sake of clarity.

Figure 4:
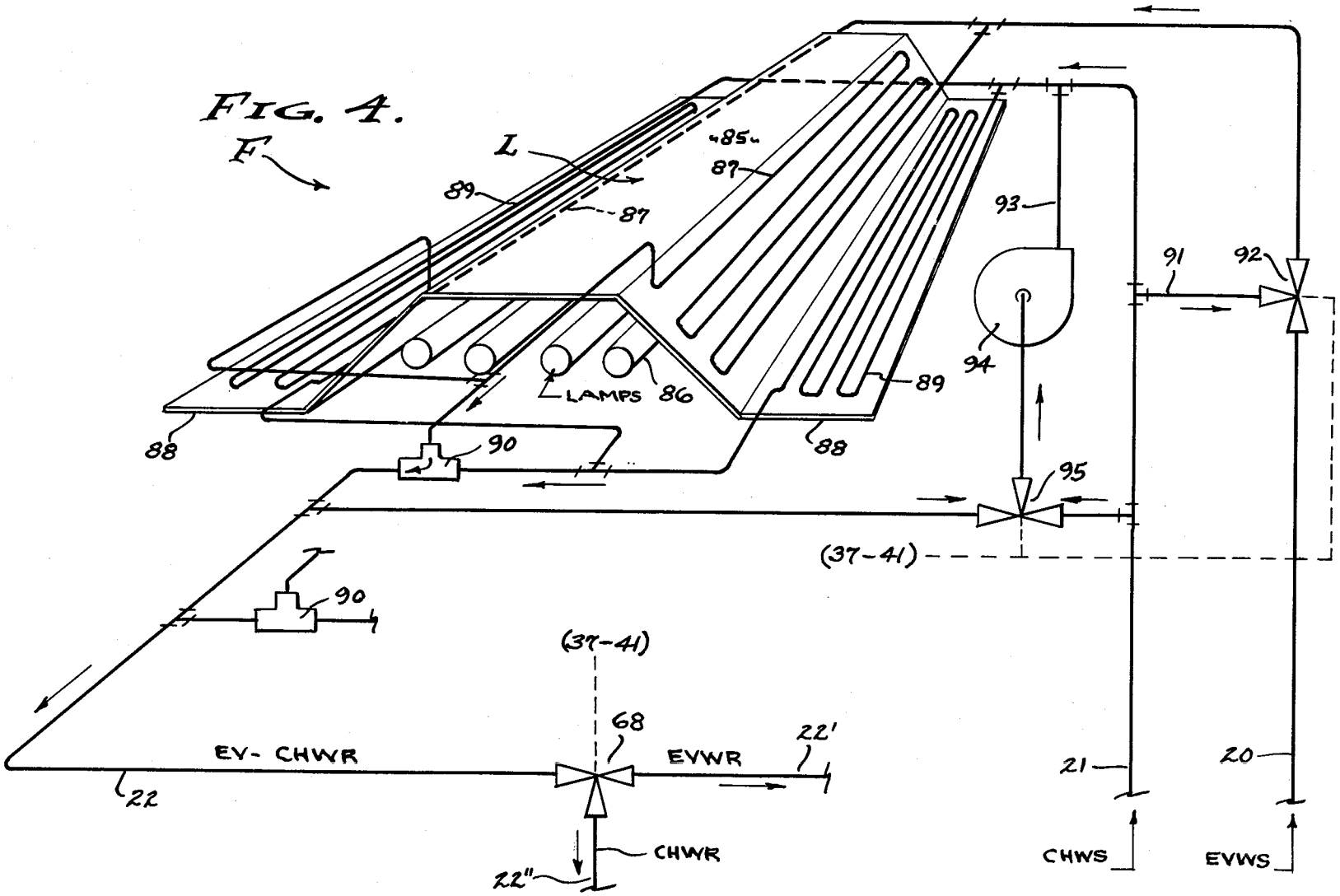
FIG. 4 is a schematic diagram of the fluid distribution means of the system.

Referring now to the liquid distribution means F as it is illustrated in FIG. 4 of the drawings, at least one and preferably a multiplicity of luminaires L are employed and installed in the ceiling (13) for dual circuit heat absorption from the waste heat of lighting and from the space zone being serviced thereby (see FIG. 1). That is, there is a dual heat transfer concept that separately employes dual media, namely the evaporatively cooled water from the line 20 and the chilled water from the water line 21. The luminaires L involve a housing 85 in which lighting means such as incandescent lamps or fluorescent lamps operate. As shown, the lamps are fluorescent tubes 86 powered through a ballast (not shown) from the lines 23. In practice, a high percentage of energy is expended as waste heat from the fixture housing 85, radiant in all directions therefrom. Accordingly, the lateral and upward radiation is captured within the housing 85 and intercepted by coils 87 in contact with the housing and through which the cooled heat transfer media from water line 20 is circulated. Therefore, a substantial portion of the heat of radiation is intercepted by the housing 85 and absorbed by the coils 87. Simultaneously, the space zone heat surrounding the fixture housing 85, as a result of downward radiation from said fixture and as a result of upward radiation and convection heat from the space zone, is intercepted by wings 88 of the housing and coils 89 in contact therewith and through which the chilled heat transfer media from water line 21 is circulated. Thereby, both lighting waste and space heat is intercepted and absorbed.

In accordance with this invention, the two liquid cooling-chilling circuits are brought together and comingle at the exhaust side of each luminaire fixture L by a comingling means in the form of a venturi fitting 90. Each venturi fitting 90 utilizes the velocity of fluid from the discharge of coil 89 to induce flow from the lower pressure discharge of coil 87, thereby pumping the comingled fluids into return line 22 for pressured recirculation by pump 69. It will be seen from FIG. 1 of the drawings that a multiplicity of luminaires L are manifolded from lines 20 and 21 to the single return line 22. Insufficient cooling of the luminaires by coils 87 is corrected by modulation of the dual heat transfer media through a transfer line 91 from the chilled water supply line 21 to the coils 87, there being a three way valve 92 in said transfer line and responsive to the space thermostat 37-41 to transfer chilled water media into coils 87 when zone space temperature rises above a predetermined level, and vice versa on a fall in temperature. Excess chilling of the luminaires by coils 89 is corrected by modulation of the dual heat transfer media through a recirculation line 93 by means of a pump 94 therein from the comingled discharge at fittings 90 to the coils 89, there being a three way valve 95 in said recirculation line and responsive to the space thermostat 37-41 to mix recirculated chilled water media with comingled liquid media into coils 89 such that on a farther rise in space temperature above a predetermined level, valve 95 opens to chilled water and closes to recirculated comingled liquid media, and vice versa on a fall in temperature.

From the foregoing it will be seen that the principles of operation in this integrated system are sound and acceptable, each complementing the other. All air entering the perimeter space zone passes through the variable volume mixing valve from a dual duct unit which operates as follows: On a fall in space temperature, the perimeter space zone thermostat 37 causes the cold damper section of the variable volume mixing valve 36 to modulate closed to some predetermined minimum ventilation position, and vice versa in a reverse condition. On a further drop in temperature, the zone thermostat causes the hot damper section of the variable volume mixing valve 36 to modulate open in accordance with net space heating demands, and vice versa in a reverse condition. The interior space zone operates substantially the same as the perimeter space zone in response to space demands for cooling or partial cooling (i.e. some heating), except that there is no direct connection from the hot air blower unit 25. As disclosed, the interior space zone draws its air from space zone air returning through the ceiling plenum and which is already above ambient room air temperature, filtered and deodorized, through a transfer duct, blower and variable volume mixing valve 38 in the ceiling space and which draws air that has already exited the conditioned space and which is, for example, delivered through activated air floor cells or through conventional ducting as shown. Since cold dampers on interior variable volume mixing boxes also have fixed minimum (mechanical) stops to guarantee ventilation, air minimums will be supplied to interior spaces at all times.

The fan systems, 24, 26 and 27 are independently controlled by means of vortex damper inlets or by means of discharge dampers or variable speed drives as necessary to hold static pressure at predetermined levels in each of their respective ducted systems. By allowing outside air to enter only through fan systems 26 and 27 the need to preheat outside air is eliminated. Lower air quantities are required to be supplied to both interior and perimeter building spaces, allowing discharge temperature from the cold air transfer unit 27 to the interior space zone to be higher than simultaneously required of the cold air transfer unit 26 to the perimeter space zone at the daily cooling peak, for example; thereby raising the average return water temperature to the chiller (evaporator section). Also with a higher return water temperature, the chiller is capable of handling more load i.e. has a greater cooling capacity, all other factors remaining the same and therefore more energy efficient than otherwise possible. A further advantage is that with less air returned to housing 28, lower overall system fan horsepower is necessary, since for air returning either to fan recirculating systems 45 or to the evaporative cooler E to be exhausted an inherent push/pull arrangement is established which permits smaller equipment and greater overall system stability under changing load conditions.

The dual stage refrigeration solves the traditional dilemma of operating refrigeration chillers as heat recovery machines (i.e. providing simultaneous building cooling and heating heat transfer media), namely that if one operates such a chiller at too low a refrigerant condensing temperature the temperature level of the outlet condenser water (i.e. 100°–105° F.) requires either an excessive (non-economic) amount of heat transfer surface or the available water temperature level is too low to do an effective job of heating in some cases i.e. as with perimeter radiation or convectors. However, if most or all of the heat discharged at the condenser is discharged to ambient it is more efficient to reduce the condensing temperature and thereby reduce the compressor work required to dissipate this heat load. Therefore, elevating the refrigerant condensing temperature to an appropriate higher level most often rules out use of conventional single stage centrifugal machines entirely. However, a condenser discharge water temperature of 130°–135° F. is the practical maximum with commercially available reciprocating or screw type positive displacement compressors. As a practical matter the proportion of (demanded) re-useable waste heat to total condenser output varies considerably over a days operation and depends upon interior loads, outdoor climatic conditions, season of the year, etc. Therefore, the ability to elevate only the required amount of condenser heat rejection in direct response to that demanded can permit a substantial annual savings in prime mover energy, particularly in summer operation when running the condenser at a higher than necessary temperature would be more costly and contribute to a higher rate of scaling and/or corrosion.

The dual stage refrigeration of this invention automatically shifts the percentage of refrigerant flowing through two stages of compression, which requires only a single stage boost. By employing an interstage cooler and a refrigerant sub-cooler, superheat is minimized and efficient compression results. The key benefits lie in the inherent self-regulation features that permit stable compresser operations while overall energy input to the compresser may fluctuate considerably i.e. at or near minimum overall system energy requirements in response to the time varying needs of the building space and domestic hot water heating distribution systems. Although two separate condensers are required, only one (common) evaporator heat exchanger is needed, thereby reducing overall system costs. The unique refrigerant sub-cooler permits expansion of a portion of high pressure liquid for sub-cooling prior to entering the chiller evaporator circuit, followed by further economizing at the interstage cooler with low pressure liquid feed to the chiller evaporator circuit.

The dual media water cooled luminaires extend the range of conventionally evaporatively cooling or chilled water cooling by the sum of both temperature ranges while allowing selection on an as needed basis, either evaporatively cooled water or a mixture of evaporatively cooled and refrigeration chilled water as is necessary for building system thermal balance i.e. recovered heat required for heat balance. As will be seen, use of evaporatively cooled water alone affords a rather small range of heat capture that is dependent on the prevailing outdoor wet bulb. For hot, humid climates the luminaires would be at an outdoor wet bulb of say 71° F. and of low efficiency resulting in a reduced heat recovery automatically shifting more cooling load to the circulating supply air distribution system. As a matter of fact, the highest prevailing wet bulbs would automatically establish the building air circulation rate for the case where only non-refrigerated water supply to luminaire is employed. For the case of supplying the luminaire housing with only chilled water, one would operate the refrigeration system at times when ambient conditions could easily deliver non-refrigerated water of the same temperature at a far lower energy requirement. Note that the system on a net call for space heating, causes the two three-way valves 92 and 95 at the luminaires to open to chilled water and close to evaporatively cooled water. In this way recovered heat is directly delivered to the chiller evaporator (in lieu of dissipating to outdoors through evaporative cooler) and since this chiller operates as a heat recovery machine the heat is automatically shifted to the high temperature heat recovery condenser section and delivered to space through this multiduct air distribution.

Flow to radiant luminaire panel "wings" is bypassed in the heating mode. On a net call for space cooling, the space thermostat causes the following sequence: On an initial rise in space temperature thermostat 37 first causes three-way valve 92 to open to chilled water flow and to close the cooling water supply and vice versa on a fall in space temperature up through the beginning of the dead band. On a further fall in space temperature (i.e. beyond the thermostat dead band), the heating mode sequence described earlier would be activated. However, valve 92 is modulated fully open to chilled water flow and on a further rise in space temperature thermostat 37 then causes three-way valve 95 to open to the chilled water supply and close to the comingled chilled and cooled water return so that the wing panels now become activated to remove additional thermal load, and vice versa on a rise in space temperature. In this way thermal (heat) loads entering the space zones are not shifted to airside cooling, thus permitting building air circulation capacity to be held to the minimum necessary for ventilation or air circulation, as appropriate. By sequencing the chilled-cooling water mixture in the manner described above, luminaire heat is preferentially removed first by low energy cooling water media and by high energy chilled water media when and as necessary to balance the load, relying finally on direct radiant space cooling only when necessary. Furthermore, since the venturi fitting permits automatic balancing of panel wing circuits, use of balancing valves on cooling-chilled water supply piping (or a reverse-return feed) is all that is necessary, and in most cases flow through both circuits can be accomplished by means of simplified primary/secondary pump circuits, as shown.

When outdoor conditions indicate high wet bulb conditions, some of the chemically dehumidified air, i.e. which can itself be cooled by cooling (not chilled) water through modulations of proportioning valve 36' and flow through line 20' only when proper ambient conditions exist, can be diverted to the inlet of evaporative cooler so as to allow more load to be removed by low energy cooling water instead of high energy chilled water.

Having described only typical preferred forms and applications of my invention, I do not wish to be limited or restricted to the specific details herein set forth, but wish to reserve to myself any modifications or variations that may appear to those skilled in the art as set forth within the limits of the following claims:

I claim:

1. An integrated multi-duct air conditioning system for building structures divided into perimeter and interior space zones, and including;

fluid distribution means delivering conditioned air separately to the perimeter and interior space zones and taking return air therefrom, evaporative cooling means supplying cooling liquid to the perimeter and interior space zones, chilling-heating means supplying separate chilling and heating liquids to the fluid distribution means and conditioning the air delivered thereby and supplying chilling liquid to the perimeter and interior space zones, and liquid distribution means receiving the evaporatively cooled liquid and applying it to the absorption of heat from lighting means in the perimeter and interior space zones respectively and receiving the chilling liquid and applying it to the absorption of space heat from the perimeter and interior space zones respectively.

2. The integrated air conditioning system as set forth in claim 1, wherein the fluid distribution means comprises "cold" and "hot" transfer units receiving said separate cooling-chilling and heating liquids respectively and with conditioned air ducting into the perimeter and interior space zones respectively.

3. The integrated air conditioning system as set forth in claim 1, wherein the fluid distribution means comprises "cold" and "hot" transfer units receiving said separate cooling-chilling and heating liquids respectively and discharging through a variable volume mixing valve with air ducting into the perimeter space zone, and a "cold" transfer unit receiving said cooling-chilling liquid with air ducting into the interior space zone.

4. The integrated air conditioning system as set forth in claim 1, wherein the fluid distribution means comprises "cold" and "hot" transfer units receiving said separate cooling-chilling and heating liquids respectively and discharging through a variable volume mixing valve with air ducting into the perimeter space zone, a blower unit and air transfer duct from one of said space zones, and a "cold" transfer unit receiving said cooling-chilling liquid and with air ducting, there being a variable volume mixing valve receiving air from the transfer duct and from said "cold" air transfer unit ducting and directing the same into the interior space zone.

5. The integrated air conditioning system as set forth in claim 1, wherein the fluid distribution means comprises "cold" and "hot" transfer units receiving said separate cooling-chilling and heating liquids respectively and with conditioned air ducting into the perimeter and interior space zones respectively, and with return air ducting from an attic plenum common to the perimeter and interior space zones.

6. The integrated air conditioning system as set forth in claim 1, wherein the fluid distribution means comprises "cold" and "hot" transfer units receiving said separate cooling-chilling and heating liquids respectively and discharging through a variable volume mixing valve with air ducting into the perimeter space zone, a blower unit and air transfer duct from one of said space zones, and a "cold" transfer unit receiving said cooling-chilling liquid and with air ducting, there being a variable volume mixing valve receiving air from the transfer duct and from said "cold" air transfer unit ducting and directing the same into the interior space zone, and with return air ducting from an attic plenum common to the perimeter and interior space zones.

7. The integrated air conditioning system as set forth in claim 1, wherein the fluid distribution means comprises "cold" and "hot" transfer units receiving said separate cooling-chilling and heating liquids respectively and with conditioned air ducting into the perimeter and interior space zones respectively, and with return air ducting from an attic plenum common to the perimeter and interior space zones and into the intake of the said "cold" and "hot" transfer units.

8. The integrated air conditioning system as set forth in claim 1, wherein the fluid distribution means comprises "cold" and "hot" transfer units receiving said separate cooling-chilling and heating liquids respectively and with conditioned air ducting into the perimeter and interior space zones respectively, and with return air ducting from an attic plenum common to the perimeter and interior space zones and exclusively into the intake of the said "hot" transfer unit.

9. The integrated air conditioning system as set forth in claim 1, wherein the fluid distribution means comprises "cold" and "hot" transfer units receiving said separate cooling-chilling and heating liquids respectively and with conditioned air ducting into the perimeter and interior space zones respectively, and with return air ducting from an attic plenum common to the perimeter and interior space zones and exclusively into the intake of the said "hot" transfer unit and into an intake plenum common to a plurality of "cold" transfer units.

10. The integrated air conditioning system as set forth in claim 1, wherein the fluid distribution means comprises "cold" and "hot" transfer units receiving said separate cooling-chilling and heating liquids respectively and discharging through a variable volume mixing valve responsive to a perimeter space zone thermostat and with air ducting into the perimeter space zone, and a "cold" transfer unit receiving said cooling-chilling liquid with air ducting into the interior space zone.

11. The integrated air conditioning system as set forth in claim 1, wherein the fluid distribution means comprises "cold" and "hot" transfer units receiving said separate cooling-chilling and heating liquids respectively and discharging through a variable volume mixing valve responsive to a perimeter space zone thermostat and with air ducting into the perimeter space zone, a blower unit and air transfer duct from one of said space zones, and a "cold" transfer unit receiving said cooling-chilling liquid and with air ducting, there being a variable volume mixing valve responsive to an interior space zone thermostat and receiving air from the transfer duct and from said "cold" air transfer unit ducting and directing the same into the interior space zone.

12. The integrated air conditioning system as set forth in claim 1, wherein the fluid distribution means comprises "cold" and "hot" transfer units receiving said separate cooling-chilling and heating liquids respectively and discharging through a variable volume mixing valve responsive to a perimeter space zone thermostat and with air ducting into the perimeter space zone, a blower unit and air transfer duct from one of said space zones, and a "cold" transfer unit receiving said cooling-chilling liquid and with air ducting, there being a variable volume mixing valve responsive to an interior space zone thermostat and receiving air from the transfer duct and from said "cold" air transfer unit ducting and directing the same into the interior space zone, and with return air ducting from an attic plenum common to the perimeter and interior space zones.

13. An integrated air recovery conditioning system for building structures, and including;

fluid distribution means delivering dehumidified conditioned air into space zones of the building and taking return air therefrom, evaporative cooling means operating on said dehumidified return air and supplying cooling liquid to the space zones, chilling-heating means supplying separate chilling and heating liquids to the fluid distribution means and conditioning the air delivered thereby and supplying chilling liquid to the space zones, and liquid distribution means receiving the evaporatively cooled liquid and applying it to the absorption of heat from lighting means within the space zones and receiving the chilling liquid and applying it to the absorption of space heat from within said space zones.

14. The integrated air recovery conditioning system as set forth in claim 13, wherein the fluid distribution means comprises at least one "cold" transfer unit drawing intake air from dehumidifying means.

15. The integrated air recovery conditioning system as set forth in claim 13, wherein the fluid distribution means comprises at least one "cold" transfer unit drawing intake air from dehumidifying means damper controlled by a return air pressure sensor.

16. The integrated air recovery conditioning system as set forth in claim 13, wherein the fluid distribution means comprises at least one "hot" transfer unit drawing intake air exclusively from damper controlled return air, there being a sensor controlled damper proportioning return air between the said evaporative cooling means and the said "cold" transfer unit.

17. An integrated two stage air conditioning system for building structures, and including;

fluid distribution means delivering conditioned air to space zones of the building structure and taking return air therefrom, two stage chilling-heating means supplying separate chilling and heating liquids to the fluid distribution means and conditioning the air delivered thereby, there being a first stage low pressure refrigeration means associated with waste heat, and there being a second stage high pressure refrigeration means associated with heat recovery, the said two stages being directed through separate waste heat and heat recovery condensors.

18. The integrated two stage air conditioning system as set forth in claim 17, wherein the two stage chilling-heating means comprises a back pressure valve in a connection between the low pressure discharge gas of a first stage compressor to the high pressure suction gas of a second stage compressor.

19. The integrated two stage air conditioning system as set forth in claim 17, wherein the two stage chilling-heating means comprises an evaporator receiving comingled low pressure liquid from a first stage refrigerant compressor and pressure reduced high pressure liquid from a second stage refrigeration compressor.

20. The integrated two stage air conditioning system as set forth in claim 17, wherein the two stage chilling-heating means comprises an evaporator receiving comingled low pressure liquid in the range of 110° to 130° F. from a first stage refrigeration compressor and pressure reduced high pressure liquid in the range of 130° to 160° F. from a second stage refrigeration compressor.

21. The integrated two stage air conditioning system as set forth in claim 17, wherein the two stage chilling-heating means comprises an evaporator receiving low pressure liquid from the waste heat condensor through an interstage cooler cooled by low pressure liquid from a first stage refrigeration compressor.

22. The integrated two stage air conditioning system as set forth in claim 17, wherein the two stage chilling-heating means comprises an evaporator receiving high pressure liquid from the heat recovery condensor through a sub-cooler chilled by high pressure liquid from a second stage refrigeration compressor.

23. The integrated two stage air conditioning system as set forth in claim 17, wherein the two stage chilling-heating means comprises an evaporator receiving comingled low pressure liquid from a first stage refrigeration compressor through the waste heat condensor and through an interstage cooler cooled by low pressure liquid from a first stage refrigeration compressor, and from the second stage refrigeration compression through the heat recovery condensor and through a sub-cooler chilled by high pressure liquid from the second stage refrigeration compression.

24. The integrated two stage air conditioning system as set forth in claim 17, wherein the two stage chilling-heating means comprises an evaporator receiving comingled low pressure liquid from a first stage refrigeration compressor through the waste heat condensor and through an interstage cooler cooled by low pressure liquid from a first stage refrigeration compressor, and from the second stage refrigeration compression through the heat recovery condensor and through a sub-cooler chilled by high pressure liquid from the second stage refrigeration compression, there being an expansion valve from the high pressure liquid discharge of the heat recovery condensor and into the sub-cooler heat exchanger section and subsequently into the interstage cooler heat exchanger section.

25. The integrated two stage air conditioning system as set forth in claim 17, wherein the two stage chilling-heating means comprises an evaporator receiving comingled low pressure liquid from a first stage refrigeration compressor through the waste heat condensor and through an interstage cooler cooled by low pressure liquid from a first stage refrigeration compressor and from a sub-cooler chilled by high pressure liquid from second stage refrigeration compressor.

26. The integrated two stage air conditioning system as set forth in claim 17, wherein the two stage chilling-heating means comprises an evaporator receiving comingled low pressure liquid from a first stage refrigeration compressor through the waste heat condensor and through an interstage cooler cooled by low pressure liquid from a first stage refrigeration compressor, and from a second stage refrigeration compressor through the heat recovery condensor and through a sub-cooler chilled by high pressure liquid from the second stage refrigeration compressor, there being an expansion valve from the high pressure liquid discharge of the heat recovery condensor and into the sub-cooler heat exchanger section and subsequently into the interstage cooler heat exchanger section.

27. An integrated dual stage liquid media heat transfer air conditioning system for building structure space zones having luminaire lighting, and including;

fluid distribution means delivering conditioned air to a space zone of the building structure and taking return air therefrom, evaporative cooling means supplying cooling liquid to said space zone, chilling-heating means supplying chilling and heating liquids to said space zone and conditioning the air delivered thereby to the fluid distribution means, and liquid distribution means receiving the evaporatively cooled liquid and applying it to absorption of heat from the luminaires and receiving the chilling liquid and applying it to the absorption of heat from the space zone surrounding said luminaires.

28. The integral dual media heat transfer air conditioning system as set forth in claim 27, wherein the evaporatively cooled liquid and chilled liquid are comingled after the heat absorption at the luminaires and subsequently separated for separate recycling through said evaporative cooling means and through said chilling means.

29. The integral dual media heat transfer air conditioning system as set forth in claim 27, wherein the evaporatively cooled liquid is temperature modulated by admixing chilling fluid through a transfer valve from said chilling means.

30. The integral dual media heat transfer air conditioning system as set forth in claim 27, wherein the chilled liquid is temperature modulated by admixing discharge thereof through a transfer valve from the luminaires after heat absorption thereby.

31. The integral dual media heat transfer air conditioning system as set forth in claim 27, wherein the evaporatively cooled liquid is temperature modulated by admixing chilling fluid through a transfer valve responsive to a space thermostat in said space zone from said chilling means.

32. The integral dual media heat transfer air conditioning system as set forth in claim 27, wherein the chilled liquid is temperature modulated by admixing discharge thereof through a transfer valve responsive to a space thermostat in the space zone from the luminaires after heat absorption thereby.

33. The integral dual media heat transfer air conditioning system as set forth in claim 27, wherein the evaporatively cooled liquid is temperature modulated by admixing chilling fluid through a transfer valve from said chilling means, and wherein the chilled liquid is temperature modulated by admixing discharge thereof through a transfer valve from the luminaires after heat absorption thereby.

34. The integral dual media heat transfer air conditioning system as set forth in claim 27, wherein the evaporatively cooled liquid is temperature modulated by admixing chilling fluid through a transfer valve responsive to a space thermostat in said space zone from said chilling means, and wherein the chilled liquid is temperature modulated by admixing discharge thereof through a transfer valve responsive to a space thermostat in the space zone from the luminaires after heat absorption thereby.

35. An integrated multi-duct air recovery conditioning system for building structures divided into perimeter and interior space zones, and including;

fluid distribution means delivering dehumidified conditioned air separately to the perimeter and interior space zones and taking return air therefrom, evaporative cooling means operating on said dehumidified return air and supplying cooling liquid to the perimeter and interior space zones, chilling-heating means supplying separate chilling and heating liquids to the fluid distribution means and conditioning the air delivered thereby and supplying chilling liquid to the perimeter and interior space zones, and liquid distribution means receiving the evaporatively cooled liquid and applying it to the absorption of heat from lighting means in the perimeter and interior space zones respectively and receiving the chilling liquid and applying it to the absorption of space heat from the perimeter and interior space zones respectively.

36. The integrated air conditioning system as set forth in claim 35, wherein liquid distribution means receives the evaporatively cooled liquid and applies it to absorption of heat from luminaires and receives the chilling liquid and applies it to the absorption of heat from the space zone surrounding said luminaires.

37. An integrated multi-duct air recovery conditioning system for building structures divided into perimeter and interior space zones, and including;

fluid distribution means delivering dehumidified conditioned air separately to the perimeter and interior space zones and taking return air therefrom, evaporative cooling means operating on said dehumidified return air and supplying cooling liquid to the perimeter and interior space zones, two stage chilling-heating means supplying separate chilling and heating liquids to the fluid distribution means and conditioning the air delivered thereby, there being a first stage low pressure refrigeration means associated with waste heat, and there being a second stage high pressure refrigeration means associated with heat recovery, said two stages being directed through separate waste heat and heat recovery condensors, and supplying chilling liquid to the perimeter and interior space zones, and liquid distribution means receiving the evaporatively cooled liquid and applying it to the absorption of heat from lighting means in the perimeter and interior space zones respectively and receiving the chilling liquid and applying it to the absorption of space heat from the perimeter and interior space zones respectively.

38. The integrated air conditioning system as set forth in claim 37, wherein liquid distribution means receives the evaporatively cooled liquid and applies it to absorption of heat from luminaires and receives the chilling liquid and applies it to the absorption of heat from the space zone surrounding said luminaires.

39. The integrated air conditioning system as set forth in claim 37, wherein liquid distribution means receives the evaporatively cooled liquid and chilling liquid and selectively applies them to the absorption of heat from dehumidifying means of the first mentioned fluid distribution means.

* * * * *